United States Patent [19]

Gunderson

[11] Patent Number: 4,485,853

[45] Date of Patent: Dec. 4, 1984

[54] OIL CHANGE METHOD

[76] Inventor: Curtis R. Gunderson, 9916 - 199th St., Lakeville, Minn. 55044

[21] Appl. No.: 582,305

[22] Filed: Feb. 22, 1984

Related U.S. Application Data

[63] Continuation of Ser. No. 460,404, Mar. 29, 1983.

[51] Int. Cl.[3] ..... B67C 9/00

[52] U.S. Cl. ..... 141/1; 137/1; 141/97; 184/1.5

[58] Field of Search ..... D2/361; 137/1; 141/1, 141/85, 87, 97; 184/1.5

[56] References Cited

U.S. PATENT DOCUMENTS

| | | | |
|---|---|---|---|
| 2,497,749 | 2/1950 | Wagner | D2/361 X |
| 3,703,956 | 11/1972 | Oswalt | 184/1.5 X |
| 4,022,257 | 5/1977 | O'Connell | 184/1.5 X |
| 4,195,710 | 4/1980 | Garrison | 184/1.5 |
| 4,269,237 | 5/1981 | Berger | 184/1.5 X |

*Primary Examiner*—Stephen Marcus
*Assistant Examiner*—Mark Thronson
*Attorney, Agent, or Firm*—Donald A. Jacobson

[57] ABSTRACT

An oil change aid device having a concave collection receptacle formed from a thin circular plastic sheet which is attached to and supported by a heavier plastic strip bent into a cylinder. A slot in the cylinder provides a hand hold to permit readily holding the device in one hand. This device is held in one hand and placed near a drain plug of an oil pan and the drain plug is then loosened through the plastic sheet using the other hand. The plastic sheet captures and contains the drain plug, and also protects the hands, arms and clothing from the drain oil. After the drain plug is removed the device is moved to permit the oil drain into a conventional oil pan and the oil poured from the device into the oil pan to permit retrieving the plug from the device.

2 Claims, 3 Drawing Figures

OIL CHANGE METHOD

This is a continuation of application Ser. No. 460,404, filed Mar. 29, 1983.

BACKGROUND OF THE INVENTION

I. Field of the Invention

This invention relates generally to an oil change aid device which permits removing the drain plug located in the bottom of the oil pan of any device having waste oil and particulars, removing the open plug of the internal combustion engine of an automobile or truck and draining the oil without soiling hands or clothing. A flexible plastic sheet forms a container impervious to oil attached to a circular stiffener which when held adjacent to a drain plug permits both withdrawing the drain plug and capturing the initial rush of drain oil which would otherwise soil hands and garments.

II. Description of the Prior Art

There are a number of devices which permit removing the drain plug in the oil pan of a vehicle or capturing the oil in the pan or both. In general devices which permit removal of the drain plug are generally relatively complex with a number of parts. The devices which are used to capture the oil, whether as a part of the drain plug remover or separately, are sized to collect all of the drain oil and not merely a quantity adequate to permit removing one's hand and arm from the vicinity of the drain plug without being soiled by the drain oil. In Higgins et al, U.S. Pat. No. 1,686,749 a pan supports a driving mechanism which is sized to fit over a drain plug when the pan is resting on the floor beneath the drain plug with a crank and shaft engaging the opposite end of the driving mechanism through a pair of spur gears.

In Mantel, Jr., U.S. Pat. No. 3,874,478 a special plug and body are substituted for a conventional drain plug in an oil pan. The new body can receive and hold a disposable oil bag which captures all of the drain oil. In O'Connell, U.S. Pat. No. 4,022,257 a funnel shaped drain device collects drain oil and routes the oil through an outlet in a side wall into a removable receptacle.

In Black U.S. Pat. No. 4,064,969 a bag held open by a structure can be placed beneath an oil pan to receive all of the drain oil through the opening and contain the oil within the bag. In Garrison U.S. Pat. No. 4,198,710 a generally rectangular shaped fill spout consisting of a frame covered with a flexible member drains into a flat pan all of which can be placed under a vehicle to receive the waste engine oil.

In the removal of an oil filter, in Klasel, U.S. Pat. No. 4,020,922 an adapter is fitted around the lower portion of an engine block over an oil filter and the adapter is used to hold a disposable plastic bag which permits rotating the bag to remove the oil filter. In Pfetzing, U.S. Pat. No. 2,746,330 a wrench is pivotably and slideably mounted in the center of a container. The container is large enough to enclose an oil filter and the filter can be loosened while the container is in place over the filter to contain the engine oil.

No prior art known to me provides the combination of attributes of the present invention, namely a reusable container with no moving parts which permits removing an oil plug while protecting the mechanic from the dirty hot waste oil.

SUMMARY OF THE PRESENT INVENTION

The present invention relates to a device used in removing the drain plug from the oil pan in an internal combustion engine used in a motor vehicle and capturing a quantity of the drain oil after the drain plug is removed. This device shields the hands and arms from the drain oil and permits first removing the drain plug and second moving the hands from the vicinity of the stream of oil without soiling the hands or arms.

A thin flexible plastic sheet is formed into a generally circular concave shape. A second plastic strip of thicker plastic is formed into a generally cylindrical shape which provides support for the flexible plastic sheet. This strip is overlapped and secured and a central slot shaped opening parallel to the cylinder ends is provided in the overlap to receive the fingers of the hand for a grip. This double thickness provides additional strength so the slot will not unduly weaken the support.

The thin plastic sheet is mounted through the support, doubled back over the support, and secured on the outside of the support to ensure that the sheet is continuous through the support. Using this approach any method of attachment can be used, including staples, and any resulting holes in the plastic sheet will be located outside of the support such that no path for motor oil will be provided through the plastic sheet within the support.

In use, the drain plug is loosened using a wrench to finger tightness. A conventional drain pan is then placed under the vehicle drain plug. Holding the device in one hand the device is then placed near the oil pan, with the edge of the cylinder holding the plastic sheet adjacent to the oil pan, and with the plastic sheet hanging down below the drain plug, and the drain plug roughly centered on the plastic sheet. The other hand is then used to loosen and remove the drain plug from the oil pan holding the drain plug through the plastic sheet. In FIG. 2 after plug 18 is initially loosened cylinder 22 is moved adjacent to the oil pan 14 to ensure that all the oil will be captured by the device. When the plug is removed the sheet will retract from the oil pan, the hand holding the plug can be removed and the plug and the oil from the engine will be captured in the plastic sheet. The oil change aid device is then removed from the vicinity of the drain hole permitting the oil to flow into the conventional drain pan, the captured oil is poured into the drain pan and the plug is retained on the device and later retrieved from the device. Since the entire operation is accomplished with the hands and arms protected by the plastic sheet no drain oil can strike them. This protection eliminates the usual mess and cleanup required when the aid is not used and also protects the mechanic from being burned by hot engine oil.

DESCRIPTION OF THE PREFERRED EMBODIMENT

Figure 1:
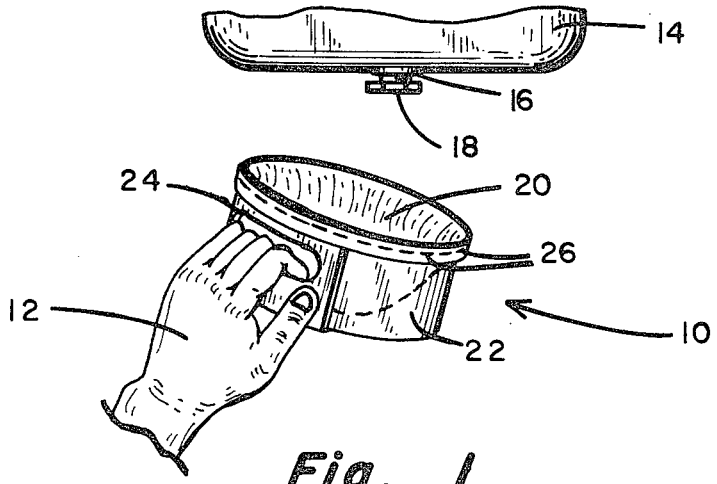
FIG. 1 is a side view of a portion of a drain pan with an isometric view of an oil change aid device held by one hand of a mechanic.

All relative directions and motions described are in reference to the relative position as shown in the various figures. Referring first to FIG. 1, the oil change aid device 10 is shown held by a hand 12 beneath an oil pan 14 with a threaded opening 16 stoppered by a matching threaded drain plug 18. Aid device 10 is made up of a thin plastic sheet 20 of approximately 2 mil thickness which forms a cavity mounted over a thicker plastic strip of approximately 30 mil thickness bent into a supporting cylindrical shape 22 and having an overlap extending across an elongated opening 24 of a size to accept the fingers of a hand. To provide additional strength cylinder 22 is glued or heat welded together at its overlap and sheet 20 is secured by staples 26 through the upper edge of cylinder 22 and only that portion of sheet 20 which is outside of the cylinder. Obviously alternative attachment means can be used, as examples: gluing, plastic welding, riveting and stitching. This ensures that the holes through sheet 20 formed by the staples 26 cannot permit oil to pass through any part of the sheet which is located within cylinder 22. Hand 12 can readily grip aid device 10 through opening 24. Aid device 10 consists functionally of plastic sheet 20 held in an open position by a supporting cylinder 22. Cylinder 22 having an overlap at the opening 24 for additional strength at the opening which provides a ready hand grip for the user.

Figure 2:
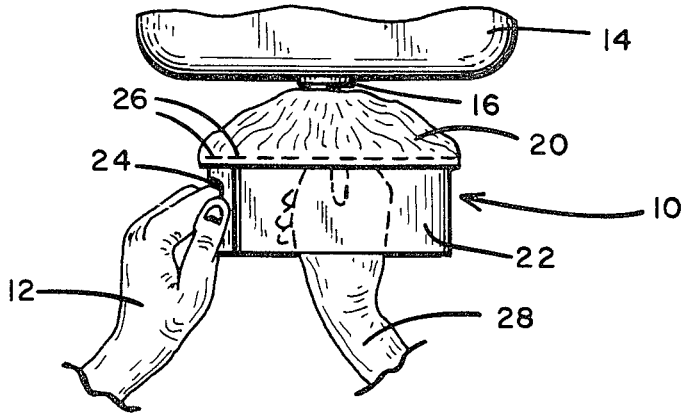
FIG. 2 is a side view of a portion of a drain pan with the oil aid device in use held by one hand of a mechanic with the other hand, shown in dashed outline within the device, removing the drain plug.

To use aid device 10 drain plug 18 is first loosened with a wrench until it is finger tight. Then the aid device is held beneath the oil pan 14, as shown in FIG. 2, with one hand 12 and the mechanics other hand 28 is used to loosen drain plug 18 through plastic sheet 20. This can readily be accomplished because of the flexibility of the plastic sheet 20 which both permits gripping the drain plug 18 through the plastic and rotating the plug relative to cylinder 22. As drain plug 18 is loosened cylinder 22 is moved adjacent to oil pan 14. When drain plug 18 is removed hand 28 can be withdrawn pulling the drain plug downward and then releasing the plug thus allowing the drain oil to pour through opening 16 into the concave shaped cavity formed by plastic sheet 20. Both the drain oil and drain plug 18 are captured and retained by plastic sheet 20.

Figure 3:
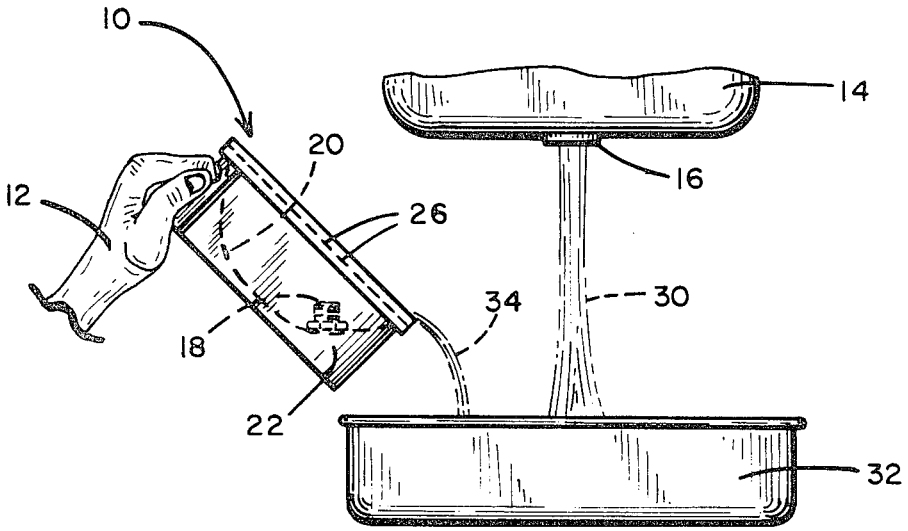
FIG. 3 is a side view of a portion of a drain with the oil change aid device after use, held by one hand of a mechanic, with a drain plug held within the oil change aid device with the flexible plastic sheet shown in dashed outline and a conventional drain pan shown in side view.

Aid device 10 can then be moved away from opening 16, as shown in FIG. 3, permitting the drain oil 30 from oil pan 14 to pour into a conventional drain pan 32 or other collection device. The drain oil 34 from aid device 10 can then be poured into drain pan 32 and drain plug 18 can be retrieved from the device. Aid device 10 can then be wiped or washed clean for later use or simply allowed to drain by inverting the device relative to the attitude shown in FIG. 2.

This aid device for assisting in changing motor oil provides a simple inexpensive aid in removing a drain plug without getting any of the dirty hot used oil on the hands, arms or clothing. No moving parts are used. The device can be reused an indefinite number of times and the simplicity permits easy and fast clean up.

Although specific construction of the herein disclosed oil change aid device has been shown and described, it is obvious that those skilled in the art may make various modifications and changes to them without departing from the scope and spirit of the present invention. It is to be expressly understood that the instant invention is limited only by the appended claims.

What is claimed is:

1. A method of removing used oil from a machine having an oil reservoir with a drain hole normally sealed by a drain plug, comprising the steps of:

(a) initially loosening said drain plug with a tool to the point where further removal can be accomplished by use of an operator's fingers;

(b) positioning beneath said drain plug a collection assembly, said collection assembly including:

(1) a generally rigid frame member having an endless band defining upper and lower open ends; and (2) a flexible, oil-impervious, sheet sealingly secured to an outer perimeter of said frame member proximate said upper open end and fitted within said frame member to form a concave-shaped pocket;

(c) reaching upward through said sheet to grasp said drain plug; and (d) removing said drain plug while holding said collection assembly in the path of flow of oil exiting said drain hole, said collection assembly shielding the fingers of the operator from contamination by the used oil.

2. The method as in claim 1 and further including the step of emptying the contents of said collection assembly into a drain pan along with the remainder of the used oil contained in said oil reservoir.

* * * * *